US007988268B2

(12) United States Patent
Morino

(10) Patent No.: US 7,988,268 B2
(45) Date of Patent: Aug. 2, 2011

(54) INK TUBE NON-CONTACT IMAGE FORMING APPARATUS

(75) Inventor: Tetsu Morino, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 1019 days.

(21) Appl. No.: 11/893,973

(22) Filed: Aug. 16, 2007

(65) Prior Publication Data

US 2008/0049087 A1 Feb. 28, 2008

(30) Foreign Application Priority Data

Aug. 23, 2006 (JP) ..... 2006-227103

(51) Int. Cl.
*B41J 2/17* (2006.01)
*B41J 2/01* (2006.01)

(52) U.S. Cl. ..... 347/84; 347/101; 347/104

(58) Field of Classification Search ..... 347/84, 347/85, 101, 104
See application file for complete search history.

(56) References Cited

U.S. PATENT DOCUMENTS

| | | | | |
|---|---|---|---|---|
| 7,278,696 | B2 * | 10/2007 | Matsuzaki et al. | 347/4 |
| 7,469,981 | B2 * | 12/2008 | Katsuyama et al. | 347/1 |
| 2002/0126180 | A1 * | 9/2002 | Hiramatsu et al. | 347/58 |
| 2004/0021746 | A1 * | 2/2004 | Sole et al. | 347/85 |
| 2004/0141029 | A1 * | 7/2004 | Maki et al. | 347/50 |

FOREIGN PATENT DOCUMENTS

| | | |
|---|---|---|
| JP | 3-161348 | 7/1991 |
| JP | 4-129751 | 4/1992 |
| JP | 11-165447 | 6/1999 |
| JP | 2000-318176 | 11/2000 |
| JP | 3236389 | 9/2001 |
| JP | 2002-321351 | 11/2002 |
| JP | 2005-35032 | 2/2005 |
| JP | 2005-35033 | 2/2005 |
| JP | 2005-199506 | 7/2005 |
| JP | 2006-15706 | 1/2006 |

* cited by examiner

*Primary Examiner* — Daniel Petkovsek
(74) *Attorney, Agent, or Firm* — Cooper & Dunham LLP

(57) ABSTRACT

An image forming apparatus comprises a printing head that ejects one or more ink drops onto a medium. The print head is mounted on a carriage and is supplied with ink via a supply tube. A sheet like member keeps the supply tube apart from the medium when the printing head ejects ink drop onto the medium.

14 Claims, 7 Drawing Sheets

INK TUBE NON-CONTACT IMAGE FORMING APPARATUS

This application claims priority, under 35 USC §119, to Japanese Patent Application No. 2006-227103 filed on Aug. 23, 2006, the entire contents of which are hereby incorporating by reference.

BACKGROUND OF THE INVENTION

1. Technical Field

This disclosure image forming apparatuses, and in particular, to image forming apparatuses having a printing head for ejecting liquid drop.

2. Discussion of the Background Art

There is an image forming apparatus that forms an image on a medium, such as a printing medium, a transfer medium, a printing sheet, a transfer sheet, etc., by adhering printing liquid to the medium during conveyance of the medium using a printing head unit having one or more liquid ejection heads that eject liquid drop.

The image forming apparatus is capable of forming an image on a medium, such as a paper, a string, a texture, a fabric, a leather, a metal, plastic, glass, wood, ceramics, etc., by ejecting liquid thereon. Such an image forming apparatus provides the medium with not only a meaningful image, such as a character, a figure, etc., but also a meaningless image, such as a pattern, etc. Such a liquid is not limited to a printing liquid or ink and includes the other types of a liquid as far as they can realize image formation. The liquid ejection apparatus is capable of ejecting liquid from a liquid ejection head, but is not limited to that forming an image.

In an example of an image forming apparatus having a liquid ejection system, a printing head is mounted on a carriage. An auxiliary tank is also mounted to supply the printing head with ink. The ink is replenished from a main toner cartridge arranged on the apparatus side to the auxiliary tank via a supply tube, such as discussed in Japanese Patent Registration No. 323689 and Japanese Patent Application Nos. 2006-015706, 2005-035032, 2005-035033, 2005-199506, 11-165447, 2000-318176, 04-129751, 2000-321351, and 04-129751.

In such image forming apparatuses, various countermeasures are taken to address problems caused by movement of the tube when the carriage moves.

However, these conventional image forming apparatuses are inadequate for preventing damage to the supply tube.

BRIEF SUMMARY

In an aspect of this disclosure, there is provided an image forming apparatus comprising a medium conveying device for conveying a medium, an ink supply source for supplying ink, a carriage driving device for driving a carriage in a prescribed direction. A printing head is arranged to eject ink drop onto the medium. The print head is mounted on the carriage and supplied with ink via a supply tube. A sheet like member is arranged to keep the supply tube apart from the medium when printing head ejects ink drop onto the medium.

In another embodiment, the sheet like member is transparent.

In yet another embodiment, a winding and unwinding device is provided to wind and unwind the sheet like member in accordance with movement of the carriage.

In yet another embodiment, a driving source is commonly used for driving the winding and unwinding device and for moving the carriage.

BRIEF DESCRIPTION OF DRAWINGS

A more complete appreciation of the aforementioned features, aspects and advantages may be better better understood by reference to the following detailed description when considered in connection with the accompanying drawings, wherein.

PREFERRED EMBODIMENTS OF THE PRESENT INVENTION

Figure 1:
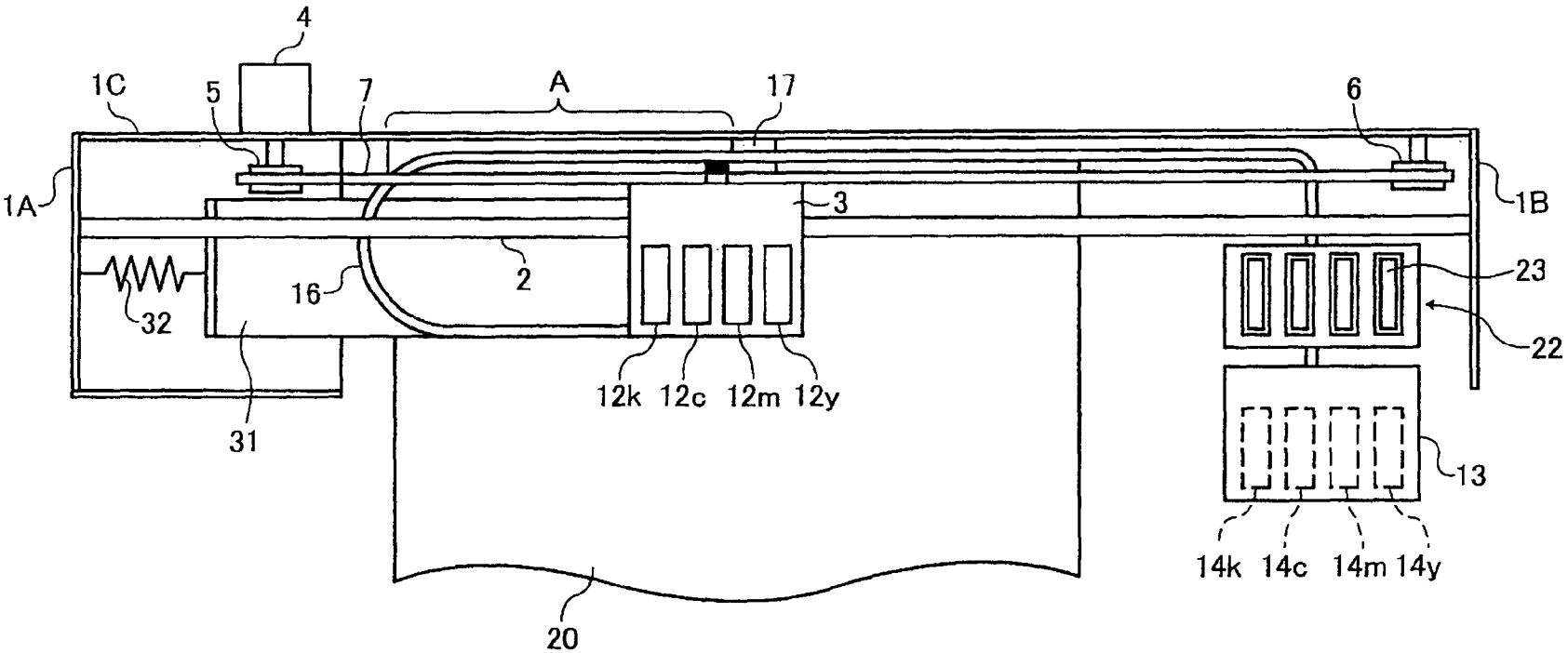
FIG. 1 is a plan view illustrating an exemplary mechanism of an image forming apparatus according to the first embodiment of the present invention.
Figure 2:
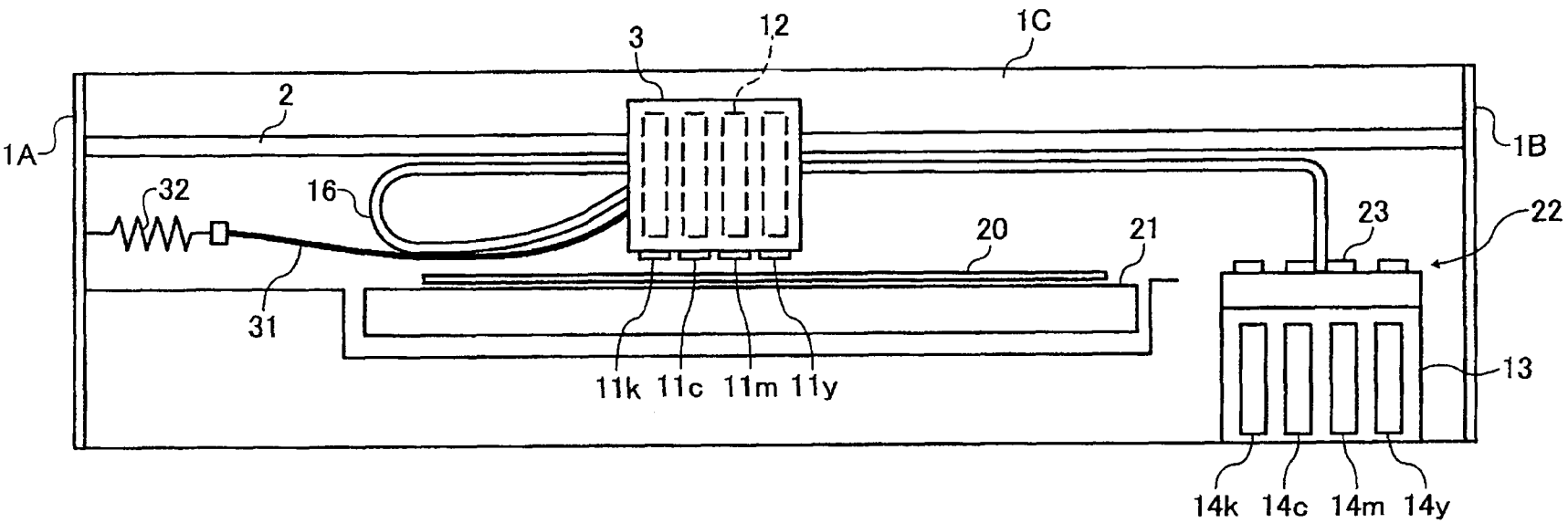
FIG. 2 is a front view of the exemplary mechanism of an image forming apparatus of FIG. 1.

Referring now to the drawing, wherein like reference numerals designate identical or corresponding parts throughout several views, in particular in FIGS. 1 and 2, an image forming apparatus of a serial type is illustrated. As shown, a carriage 3 is held by both of a main guide rod 2 and a follow guide rod, not shown, laterally suspended between body side plates 1A and 1B. The carriage 3 is thus capable of thrusting in a main scanning direction. The carriage 3 executes scanning when moved by a main scanning motor 4 via timing belt wound around driving and follower pulleys 5 and 6 in the main scanning direction.

The carriage includes a nozzle line arranged perpendicular to the main scanning direction, i.e., in a sheet feeding direction, with its liquid drop ejection direction being downward. Such a nozzle line include a plurality of printing heads 11*y*, 11*m*, 11*c*, and 11*k* (herein below, collectively referred to as a printing head 11, sometime) containing ink drops of Yellow (Y), Magenta (M), Cyan (C), and Black (B), respectively.

The carriage 3 further mounts a plurality of head tanks as auxiliary tanks 12*y*, 12*m*, 12*c*, and 12*k* (herein below, collectively referred to as a head tank 12, sometime) for supplying respective color inks corresponding to the printing heads 11*y* to 11*k*. A supply pump unit is arranged on a non-printing region and is detachably mounted on a cartridge holder 13 to replenish respective printing liquids from a plurality of printing liquid cartridges 14*y*, 14*m*, 14*c*, and 14*k* to the head tanks 12*y* to 12*k* via supply tubes 16, respectively.

The supply tube 16 is connected to the supply pump unit at its one end, and is drawn to a rear plate 1C. The supply tube 16 is then bent upwardly and is drawn in the main scanning direction along the rear plate 1C. The supply tube 16 is then bent to form a U-like shape and is connected to the head tank at its another end. A middle portion of the supply tube 16 is secured to the rear plate 1C by a tube securing member 17.

A platen 21 is arranged opposing the carriage 3 to convey a sheet 20. By moving the printing head 11 in the main scanning direction while ejecting liquid drop onto the sheet 20 and intermittently conveying the sheet 20 along the platen 21, a prescribed image is formed on the sheet 20.

A maintenance and recovery mechanism 22 is arranged in the non-printing region to maintain and recover a performance of the printing head 11.

The maintenance and recovery mechanism 22 includes a cap member 13 and similar equipment for capping a nozzle surface of the print head 11.

A sheet like member 31 is connected to the carriage 3 at its one end to hold the supply tube 16 apart from the medium 20. The other end of the sheet like member 31 is held by the side plate 1A via an elastic member 32, such as a spring, etc. The sheet like member 31 can be elastic by itself, however.

When the carriage 3 moves in the main scanning direction, the sheet like member 31 intervenes between the supply tube 16 and the sheet 20. Thus, even when the supply tube 16 droops, an interval is created between the supply tube 16 and the sheet 20 as shown in FIG. 2, because the sheet like member 31 supports the supply tube 16. Thus, even if the supply tube 16 has low rigidity, and accordingly, droops, an image carried surface of the sheet 20 is not stained by contact of the sheet 20. Accordingly, the supply tube can be low cost.

When a sheet is jammed behind the sheet like member 31, jam sheet removal becomes difficult. Then, the sheet like member 31 is preferably transparent to readily find out a jam sheet and remove it therefrom.

Figure 3:
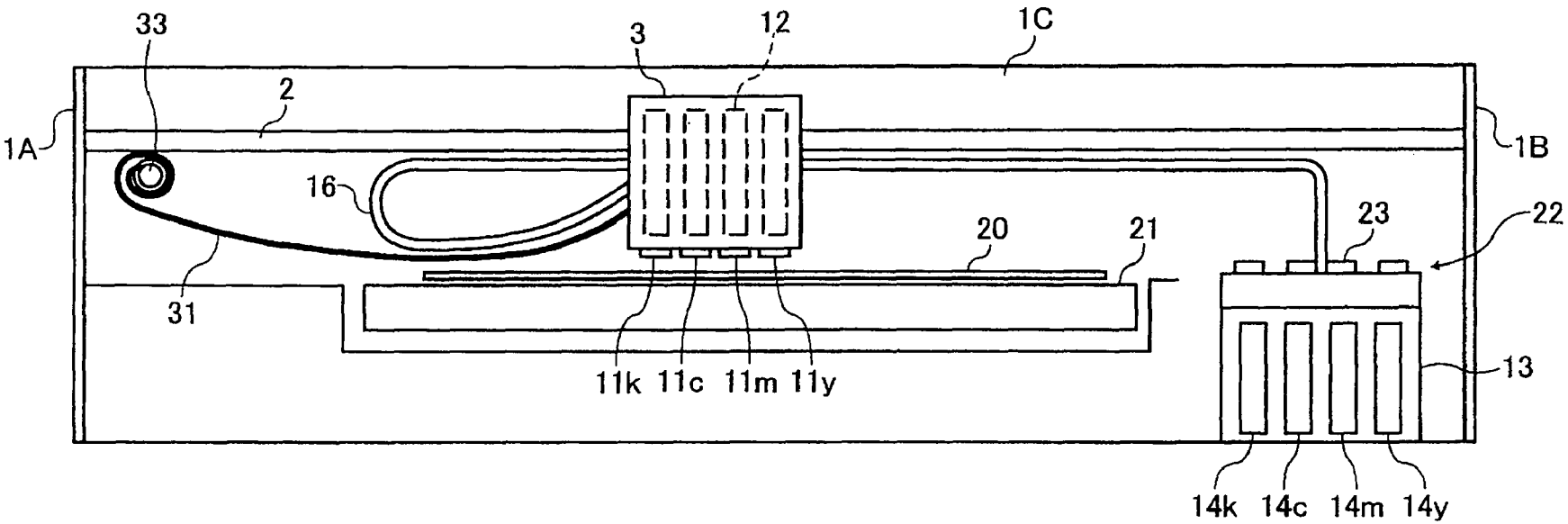
FIG. 3 is a front view illustrating an exemplary mechanism of an image forming apparatus according to the second embodiment of the present invention.

Now, a second embodiment of the present invention is described with ref to FIG. 3. As shown, another end of the sheet like member 31 is attached to a cylindrical sheet rewinding shaft 33. The sheet rewinding shaft 33 is driven and rotated by a driving source such as a motor, not shown, in accordance with a moving distance or position. Thus, these sheet rewinding shaft 33 and the driving source collectively forms unwinding and rewinding device for unwinding and rewinding the sheet like member 31 in accordance with movement of the carriage.

Specifically, when the elastic member 32 holds the other end of the sheet like member 31 as described in the first embodiment, an elastic force of the elastic member 32 changes, and accordingly, a load on the carriage 3 largely varies in proportion to the moving distance. As a result, main scanning likely becomes unstable. Then, the sheet like member 31 is unwound and rewound in synchronism with the movement of the carriage 3. Thus, the load variation of the carriage is suppressed, and main scanning can be stable.

It is costly if an extra driving source is employed to rotate and drive the sheet rewinding shaft 33. Then, the pulley and the timing belt serves as a driving force transmission mechanism and cooperatively convey the driving force of the main scanning motor 4. Thus, a configuration can be simple at low cost.

Figure 4:
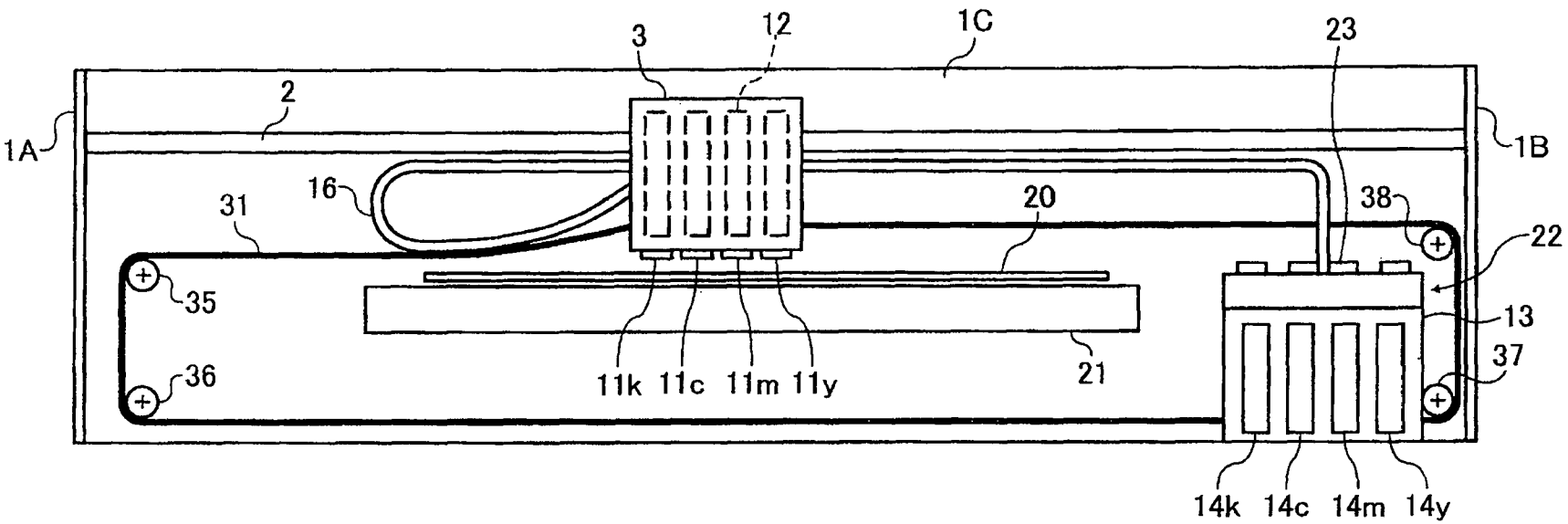
FIG. 4 is a front view illustrating an exemplary mechanism of an image forming apparatus according to the third embodiment of the present invention.

Now, a third embodiment of the present invention is described with ref to FIG. 4. As shown, both ends of a sheet like member 31 are secured to both sides of the carriage 3, respectively. The sheet like member 31 is wounded around a plurality of freely rotatable rollers 35 to 38. Specifically, the sheet like member 31 starts and ends at the carriage 3 thereby forming a loop. Thus, an interior space can be saved.

Now, a fourth embodiment is described. The loop state sheet like member 31 is rotated by the main scanning motor 4 and moves the carriage 3. The sheet like member 31 preferably partially includes a V-shaped groove to engage with a pulley as the timing belt to maintain positional precision.

Now, exemplary material of the sheet like member 31 and the supply tube 16 is described. When the sheet like member 31 supports the drooping supply tube 16 as mentioned earlier, movement of the carriage 3 creates friction between the supply tube 16 and the sheet like member 31.

In view of the above, the surface of the sheet like member 31 is coated with fluorine resin, for example, to create a high thrusting performance. Thus, friction resistance created between the supply tube 16 and the sheet like member 31 is reduced. Since it is costly to entirely coat the surface of the sheet like member 31 with the fluorine resin, the fluorine resin is only coated onto a portion contacted by the supply tube 16 so as to partially create a high thrusting performance.

The supply tube 16 itself can be made of material having a low friction coefficient and a high thrusting performance, such as PP, etc. Thus, similar effect can be obtained as above including when a portion of the supply tube 16 contacted by the sheet like member 31 is partially coated.

Figure 5:
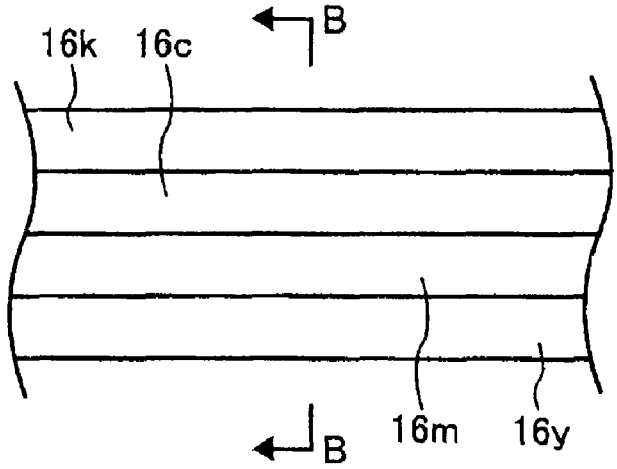
FIG. 5 is a main front view illustrating an exemplary configuration capable of preventing a supply tube from being entangled.
Figure 6:
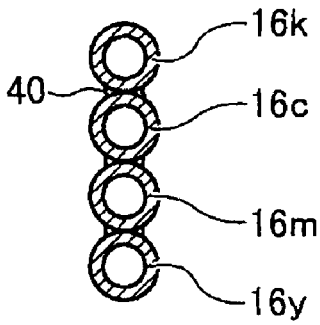
FIG. 6 is a cross sectional view of the exemplary configuration of FIG. 5 when viewed at the section defined there by the line B-B.

Now, an exemplary configuration capable of avoiding entwining of a plurality of supply tubes 16 is described with ref to FIGS. 5 and 6. As shown, a plurality of supply tubes 16*y* to 16*k* are adhered and integrated with each other using adhesive 40, or is fused together. Thus, a continuous tube is formed. As a result, the plurality of tubes can be avoided from being entangled.

Now, an exemplary modification is described. Specifically, only portions of the plurality of supply tubes 16*y* to 16*k* moving along with the carriage 3 within a region A as shown in FIG. 1 are adhered and integrated with each other.

Figure 7:
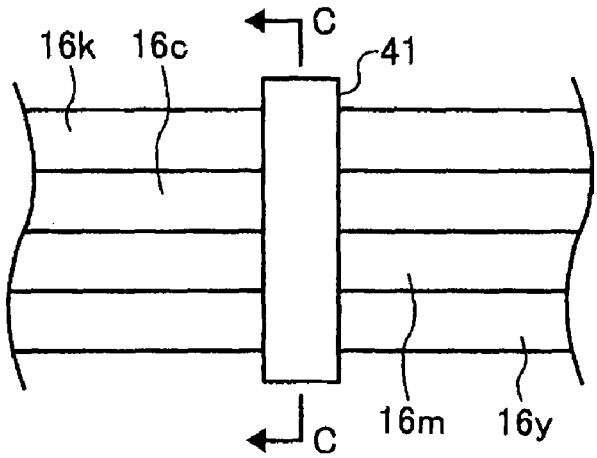
FIG. 7 is a main front view illustrating another exemplary configuration capable of preventing a supply tube from being entangled.
Figure 8:
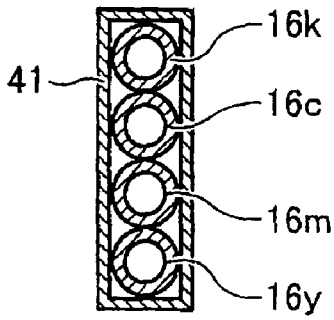
FIG. 8 is a cross sectional view of the other exemplary configuration of FIG. 7 when viewed at the section defined there by the line C-C.

Now, another modification is described with ref to FIGS. 7 and 8. As shown, a clump member 41 is arranged at a moving section to bundle each of the plurality of supply tubers 16*y* to 16*k*.

Figure 9:
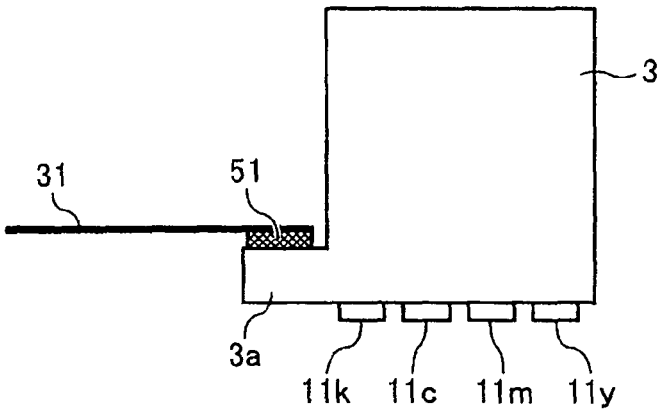
FIG. 9 is a schematic front view illustrating an exemplary manner of attaching a sheet like member to a carriage.

Now, an exemplary manner of attaching a sheet like member to a carriage is described with ref to FIG. 9.

As shown, one end of the sheet like member 31 is connected to one side of the carriage 3 with adhesive 51 or by means of fusing. Thus, the sheet like member 31 can be firmly attached to the carriage 3.

Figure 10:
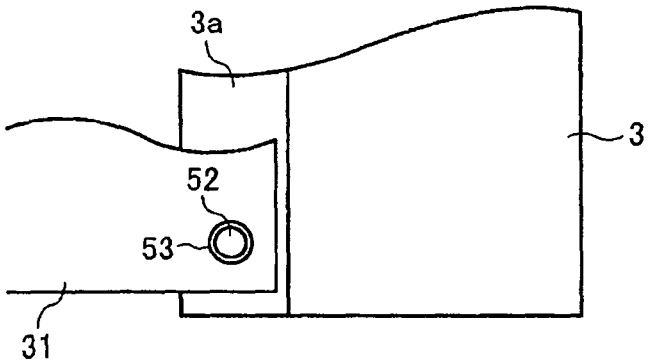
FIG. 10 is a schematic plan view illustrating another exemplary manner of attaching a sheet like member to a carriage.
Figure 11:
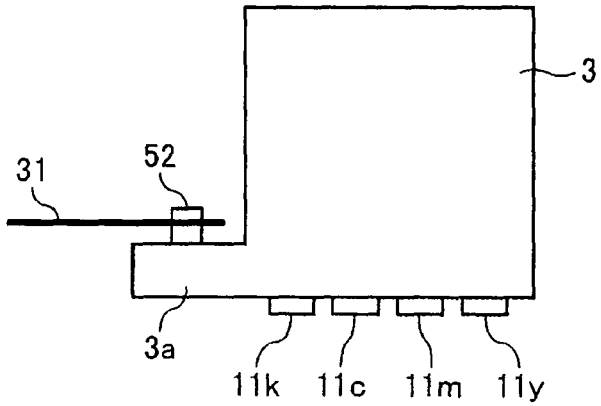
FIG. 11 is a schematic front view of the other exemplary configuration of FIG. 10.

Now, an exemplary modification is described with ref to FIGS. 10 and 11.

As shown, a protrusion (e.g. a pin) 52 is arranged on a portion 3*a* of the one side of the carriage 3 so as to engage with one end of the sheet like member 31. The one end of the sheet like member 31 includes a hole 53 engagable with the pin 32. Thus, the sheet like member 31 is detachably attached to the carriage 3 by engaging the hole 53 with the pin 52. Accordingly, the sheet like member 31 can be readily secured and detached.

The image forming apparatus according to the present invention can be applied to a facsimile, a copier, and a multiple functional machine including functions of the printer, the copier, and the facsimile. Further applied is an image forming apparatus using printing liquid, such as resist, etc., or DNA sample as used in a medical field.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

a medium conveying device configured to convey a medium;

an ink supply source configure to store ink;

a carriage driving device configured to drive a carriage in a prescribed direction;

a printing head configured to eject an ink drop onto the medium, said printing head being mounted on the carriage and supplied with ink via at least one supply tube; and a holder sheet configured to separately hold the supply tube apart from the medium when the printing head ejects the ink drop onto the medium, wherein one end of said holder sheet is connected to one side of the carriage and the other end of the holder sheet is connected to one of a side plate of the image forming apparatus and the other side of the carriage.

2. The image forming apparatus as claimed in claim 1, wherein said holder sheet is transparent.

3. The image forming apparatus as claimed in claim 1, wherein said holder sheet includes a high thrusting performance at its surface.

4. The image forming apparatus as claimed in claim 3, wherein only a section of the surface contacting the supply tube includes the high thrusting performance.

5. The image forming apparatus as claimed in claim 1, wherein said at least one supply tube is made of material having a high thrusting performance.

6. The image forming apparatus as claimed in claim 1, wherein said supply tube is made of material having a high thrusting performance at its portion contacting the holder sheet.

7. The image forming apparatus as claimed in claim 1, wherein said at least one supply tube includes at least two supply tubes for conveying different color ink, and wherein said at least two supply tubes are integrated with each other.

8. The image forming apparatus as claimed in claim 7, wherein only movable portions of said at least two supply tubes are integrated with each other.

9. The image forming apparatus as claimed in claim 7, wherein only movable portions of the at least two supply tubes are clamped.

10. The image forming apparatus as claimed in claim 1, wherein said holder sheet is disposed between the medium and the supply tube such that the medium is separated by a spatial interval from the supply tube.

11. An image forming apparatus, comprising:

a medium conveying device to convey a medium;

an ink supply source to store ink;

a carriage driving device to drive a carriage in a prescribed direction;

a printing head to eject an ink drop onto the medium, said printing head being mounted on the carriage and supplied with ink via at least one supply tube; and a holder sheet to separately hold the supply tube apart from the medium when the printing head ejects the ink drop onto the medium; and a winding and unwinding device to wind and unwind the holder sheet in accordance with movement of the carriage, wherein one end of said holder sheet is connected to one side of the carriage and the other end of the holder sheet is connected to the winding and unwinding device.

12. The image forming apparatus as claimed in claim 11, wherein said carriage driving device drives said winding and unwinding device.

13. The image forming apparatus as claimed in any one of claim 11, wherein said holder sheet is formed in a loop state surrounding the medium starting from and ending at the carriage.

14. The image forming apparatus as claimed in claim 13, wherein said holder sheet forms a part of the carriage driving device.

* * * * *